US009022308B2

(12) United States Patent
Turnbull

(10) Patent No.: US 9,022,308 B2
(45) Date of Patent: May 5, 2015

(54) CRUSHER BUCKET

(75) Inventor: Sam Dominic Seaton Turnbull, Wagga Wagga (AU)

(73) Assignee: Flip Screen Australia Pty Ltd, Wagga Wagga, NSW (AU)

( * ) Notice: Subject to any disclaimer, the term of this patent is extended or adjusted under 35 U.S.C. 154(b) by 245 days.

(21) Appl. No.: 13/806,832

(22) PCT Filed: Jun. 23, 2011

(86) PCT No.: PCT/AU2011/000773

§ 371 (c)(1),
(2), (4) Date: Mar. 8, 2013

(87) PCT Pub. No.: WO2012/000018

PCT Pub. Date: Jan. 5, 2012

(65) Prior Publication Data

US 2013/0161429 A1 Jun. 27, 2013

(30) Foreign Application Priority Data

Jun. 28, 2010 (AU) ..... 2010902852

(51) Int. Cl.

| | |
|---|---|
| ***B02C 1/08*** | (2006.01) |
| ***E02F 3/407*** | (2006.01) |
| ***E02F 3/96*** | (2006.01) |
| ***E02F 7/06*** | (2006.01) |

(52) U.S. Cl.
CPC . *B02C 1/08* (2013.01); *E02F 3/407* (2013.01); *E02F 3/965* (2013.01); *E02F 7/06* (2013.01)

(58) Field of Classification Search
CPC ..... B02C 1/08; B02C 1/10
USPC ..... 241/101.73, 266
See application file for complete search history.

(56) References Cited

U.S. PATENT DOCUMENTS 5,533,682 A * 7/1996 de Gier et al. ..... 241/101.73
2008/0217452 A1 9/2008 Douglas

FOREIGN PATENT DOCUMENTS

JP 116309 1/1999

* cited by examiner

*Primary Examiner* — Mark Rosenbaum
(74) *Attorney, Agent, or Firm* — O'Shea Getz P.C.

(57) ABSTRACT

A bucket (10) that is attachable to a piece of earth moving equipment by means of transverse shafts (11). The bucket (10) includes an outer casing (12) providing an upper (first) jaw member (13) and a lower (second) jaw member (14) so as to generally encompass a passage (15) along which material to be crushed passes from a passage inlet (16) to a passage outlet (17). Preferably the jaw member (13) includes an attachment assembly (42) that provides for attachment of the bucket (10) via shaft (35) to the piece of moving equipment that is to use the bucket (10).

8 Claims, 5 Drawing Sheets

10
11
11
42
13
35
37
18
19
15
16
14
33
20
20
20
20
23
24
23
24
17

22
18
26
27
30
31
29
28
36

CRUSHER BUCKET

This patent applications claims priority to PCT Patent Application no. PCT/AU2011/000773 filed Jun. 23, 2011, which claims priority to Australian Patent Application No. 2010902852 filed Jun. 28, 2010, the disclosure of which is herein incorporated by reference.

TECHNICAL FIELD

The present invention relates to crushing assemblies and more particularly but not exclusively to crushing assemblies employed in buckets of earth moving equipment, such as excavators.

BACKGROUND OF THE INVENTION

Earth moving equipment, such as excavators have a bucket that is manipulated to move material. Frequent the material may include rock and/or building products such as concrete which need to be crushed. It is known to incorporate in these buckets rollers that crush the material as the material passes through the bucket.

It is a disadvantage of the above described buckets that if contaminants (such as metal objects) the bucket can be damaged.

OBJECT OF THE INVENTION

It is the object of the present invention to overcome or substantially ameliorate the above disadvantage.

SUMMARY OF THE INVENTION

There is disclosed herein a crushing assembly including:

a first jaw member;

a second jaw member cooperating with the first jaw member to provide a passage along which material to be crushed passes from a passage inlet to a passage outlet, the passage having a transverse height extending between the jaw members;

an actuator associated with the jaw members and operable to alter the height so that the height diminishes from said inlet to said outlet;

a plurality of rollers extending transverse of the passage and which engage the material to aid in crushing the material; and a motor to rotatably drive at least one of the rollers.

Preferably, the rollers are mounted in the first jaw member.

Preferably, the first and second jaw members are pivotally attached adjacent said inlet for relative angular movement to alter said height.

Preferably, said actuator is located adjacent said outlet.

Preferably, said second jaw member has cutting ridges that engage the material passing along the passage.

Preferably, at least one of the rollers has a generally central longitudinal axis, and the roller is mounted for rotation about a rotational axis spaced from the longitudinal axis.

Preferably, all of the rollers have a longitudinal axis, and each of the rollers has a respective rotational axis that is spaced from the respective longitudinal axis of the roller.

Preferably, at least one of the rollers includes a roller body, and a roller sleeve mounted on the roller body so as to generally encompass the roller body and movable angularly thereabout.

Preferably, the crusher assembly is a bucket including a scoop portion adjacent said inlet to aid in delivering material to said passage.

BRIEF DESCRIPTION OF THE DRAWINGS

A preferred form of the present invention will now be described by way of example with reference to the accompanying drawings wherein.

DETAILED DESCRIPTION OF THE PREFERRED EMBODIMENT

Figure 1:
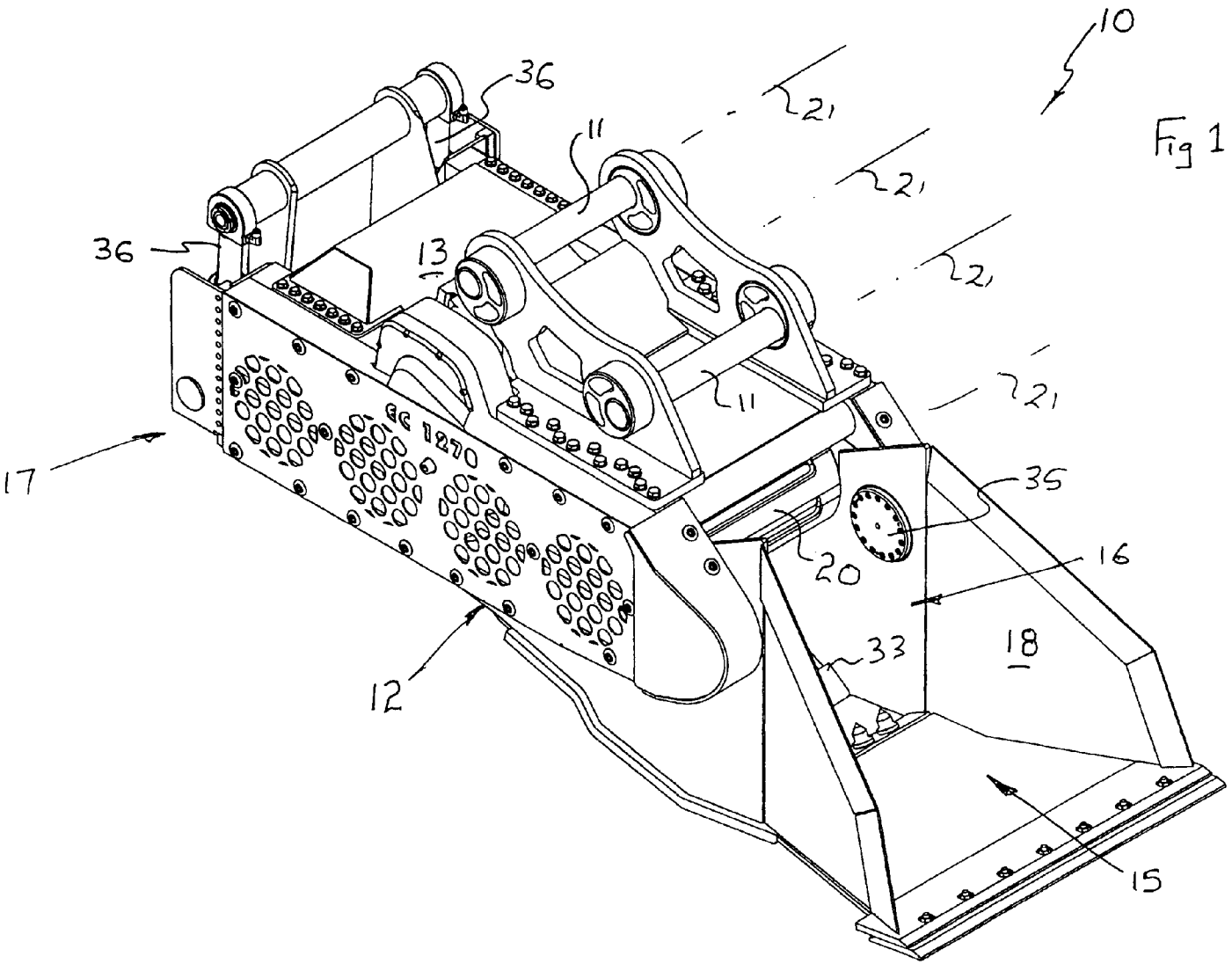
FIG. 1 is a schematic isometric view for a bucket to be employed by a piece of earth moving equipment such as an excavator.
Figure 2:
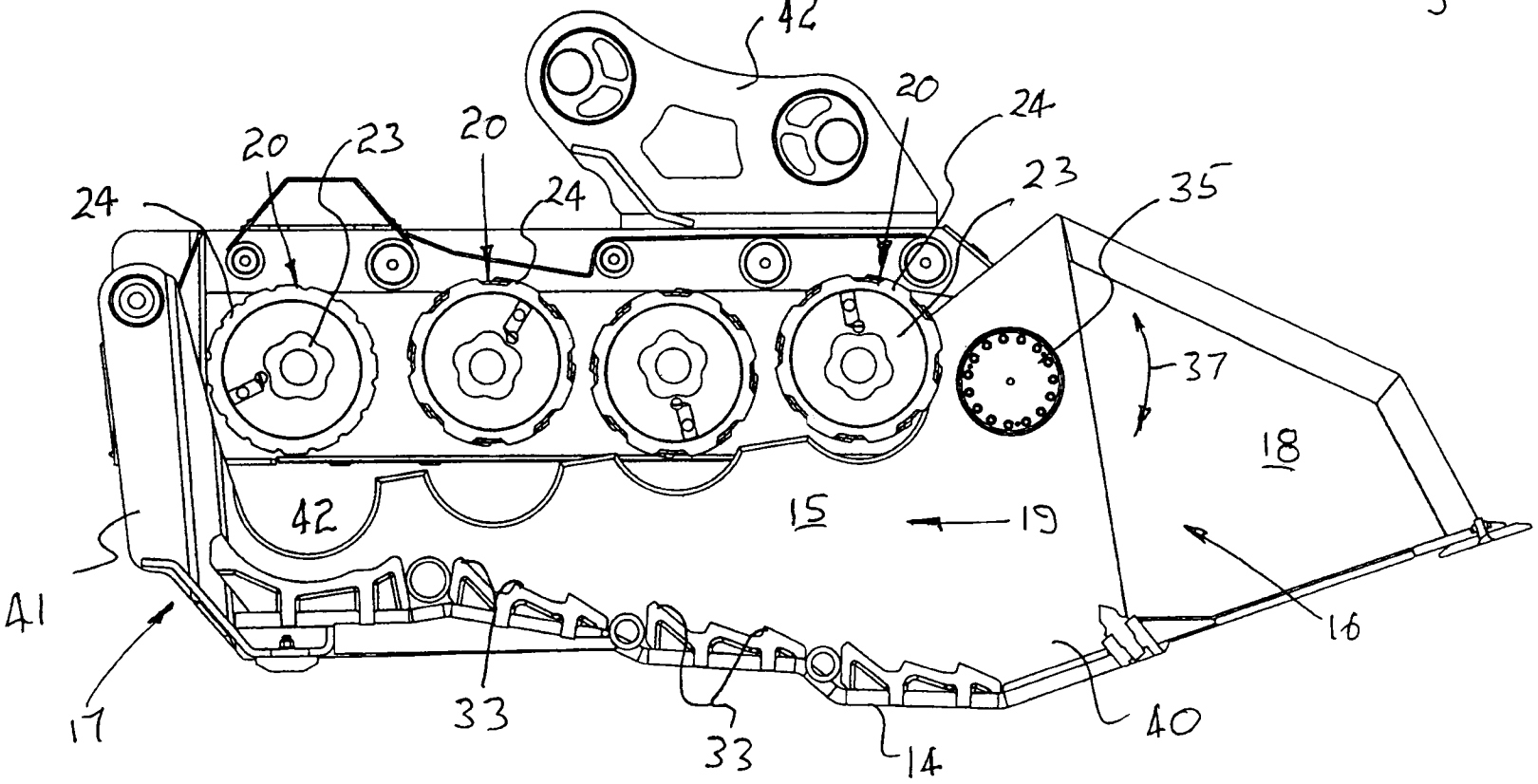
FIG. 2 is a schematic parts sectioned side elevation of the bucket of FIG. 1.
Figure 3:
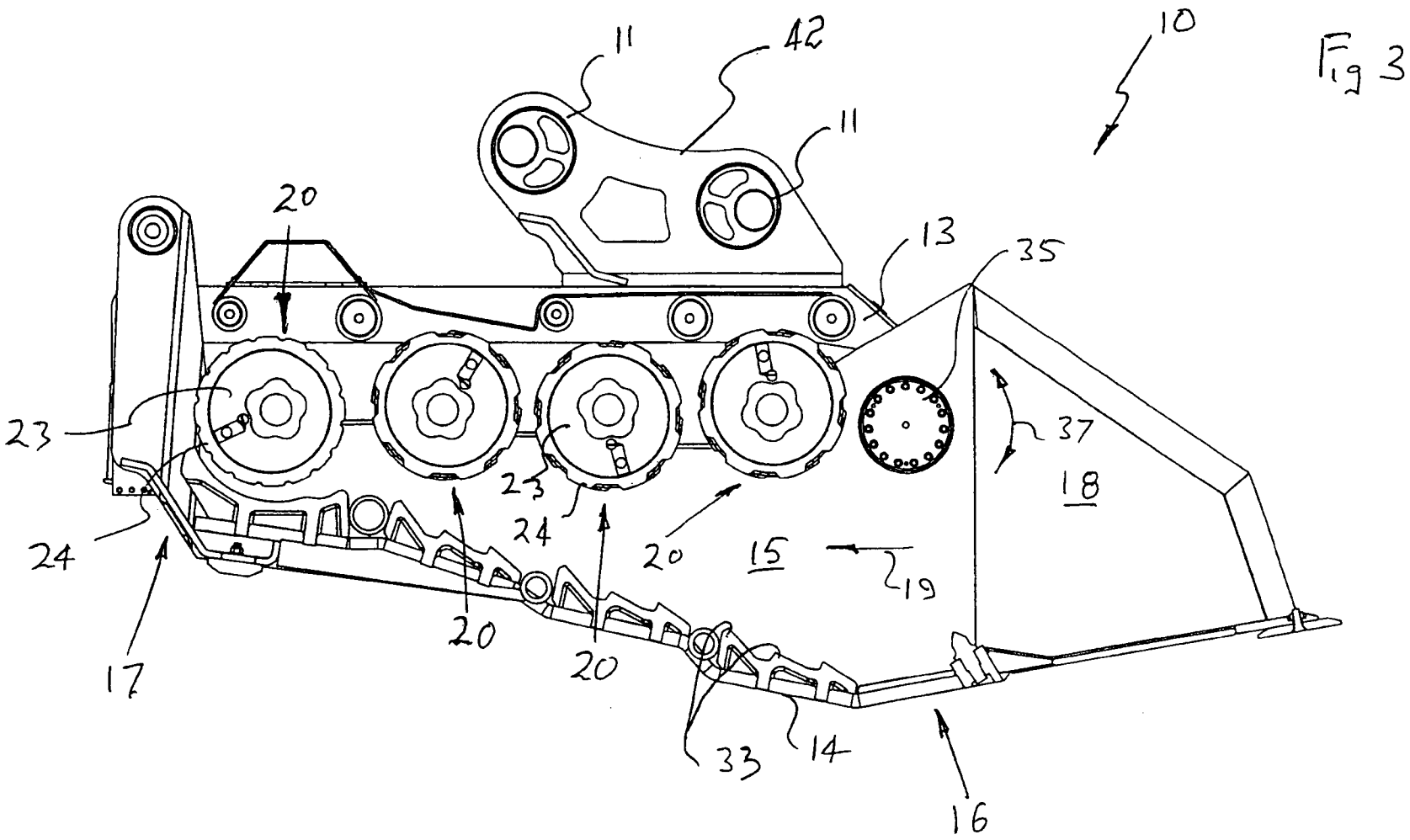
FIG. 3 is a further schematic parts sectioned isometric view of the bucket of FIG. 1.
Figure 4:
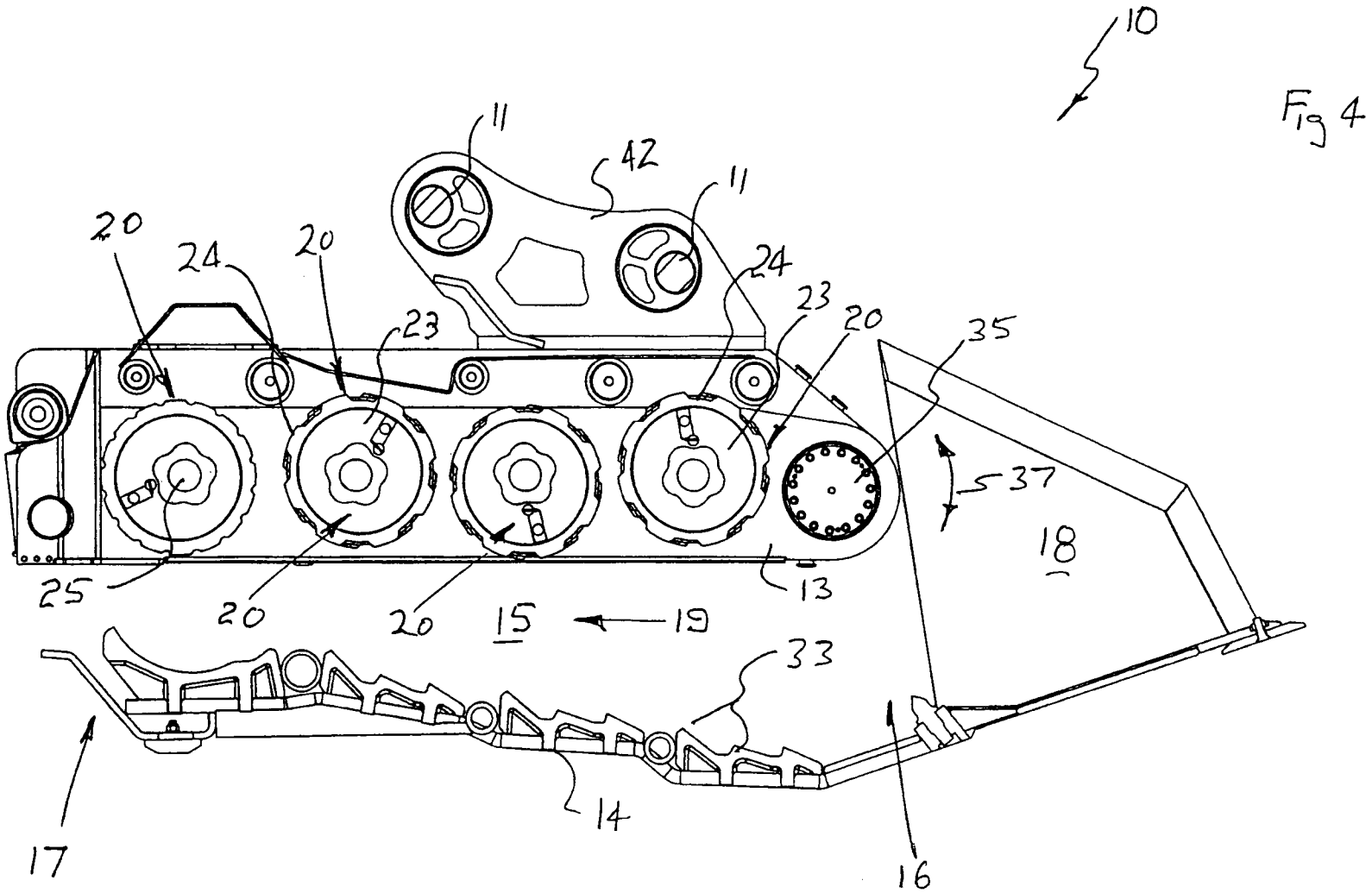
FIG. 4 is a still further schematic sectioned side elevation of the bucket of FIG. 1.
Figure 5:
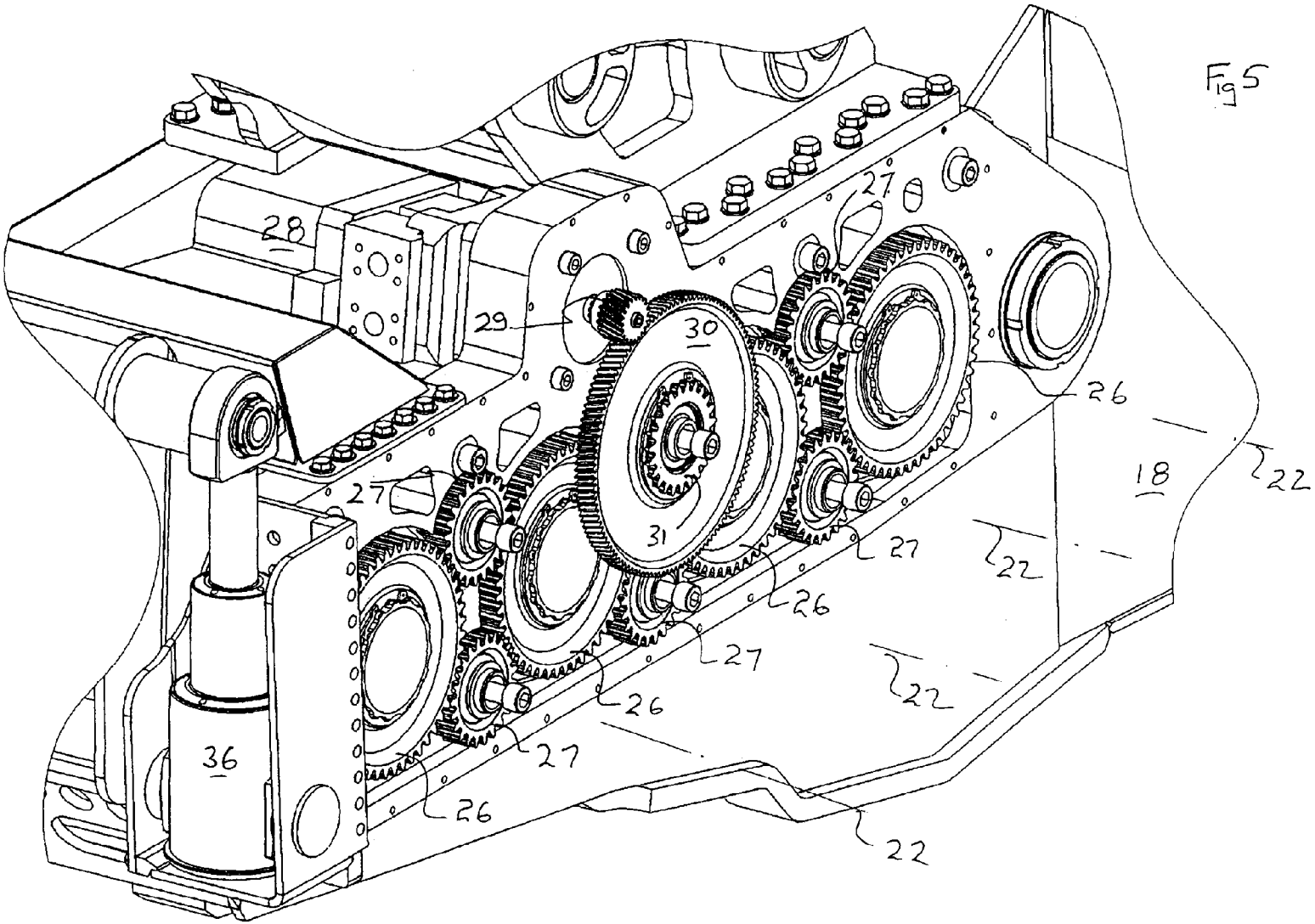
FIG. 5 is a schematic isometric view of a drive assembly of the bucket of FIG. 1.

In the accompanying drawings there is schematically depicted a bucket 10. The bucket 10 (as an example) could be attached to the arm of a piece of earth moving equipment by means of transverse shafts 11.

The bucket 10 includes an outer casing 12 providing an upper (first) jaw member 13 and a lower (second) jaw member 14 so as to generally encompass a passage 15 along which material to be crushed passes from a passage inlet 16 to a passage outlet 17.

Mounted on the lower jaw member 14 is a scoop 18 that is manipulated to gather material and deliver material to the passage 15. Typically the piece of earth moving equipment would be manipulated so as to provide the passage 15 with a desired inclination to aid in movement of the material in the direction 19 under the influence of gravity.

Mounted in the jaw member 13 is a plurality of rollers 20, each of the rollers 20 is generally cylindrical in configuration so as to have a generally longitudinally extending central axis 21. However each of the rollers 20 is mounted for rotation about a rotational axis 22. The axes 21 and 22 are all generally parallel, however in respect of each roller 20, its respective axes 21 and 22 are spaced so that the rollers 20 rotate in an eccentric manner. Accordingly, as each roller 20 rotates about its rotational axis 22, its longitudinal axis 21 moves angularly about its associated axis 22.

Each roller 20 includes a roller body 23 and a radially outer roller sleeve 24, with each sleeve 24 being rotatable about its respective body 23. Preferably, bearings are located between each body 23 and its respective sleeve 24.

Each of the rollers 20 has a supporting shaft 25 at one end, while the other end is provided with a drive gear 26. The gears 26 are drivingly coupled by idler gears 27, with the gears 22 being driven by a hydraulic motor 28. More particularly the motor 28 drives a pinion gear 29 that in turn drives a primary gear 30 that via an internal gear 31 drives the two adjacent gears 26.

Preferably, the motor 28 and its associated drive train rotates the rollers 20 in the angular direction 32.

Preferably, the jaw member 14 has cutting ridges 33 (with edges extending transverse of the passage 15) that aid in crushing the material passing along the passage 15 in the direction 19.

The jaw member 14 is pivotally attached to the jaw member 13 adjacent the inlet 16 by means of pivot shafts 35, with the rear of the jaw members 13 and 14 being engaged by hydraulic cylinders 36 that provide for angular relative movement between the jaw members 13 and 14 in the angular direction 37 to alter transverse height 38 of the passage 19 so that during a crushing operation the size of material to exit the passage 15 can be at least partly predetermined.

Preferably, the hydraulic cylinders 36 are coupled to a hydraulic circuit 39 that governs flow of hydraulic to and from the cylinders 36 so that should an object (such as a metal object) enter and pass along the passage 15, the object being larger than the height 38, the cylinders 36 extend to increase the height 38 therefore provide for movement of the object so as to exit the outlet 17. Thereafter the cylinders 36 will move the jaw member 14 to again return the jaw member 14 to a position at which the passage 15 has a desired height 38.

The jaw member 14 includes jaw side walls 40 that is engaged by the shafts 35 engages, while the hydraulic cylinders 36 pivotally extend between the jaw member 13 and an upper portion 41 of the side walls 40. Preferably, the side walls 40 have "cut-outs" 42 that provide for the side walls 40 to clear the rollers 20.

Preferably, the jaw member 13 includes an attachment assembly 42 that provides for attachment of the bucket 10 via shafts 35 to the piece of earth moving equipment that is to use the bucket 10.

The invention claimed is:

1. A crushing assembly including:

a first jaw member;

a second jaw member cooperating with the first jaw member to provide a passage along which material to be crushed passes from a passage inlet to a passage outlet, the passage having a transverse height extending between the jaw members;

an actuator associated with the jaw members and operable to alter the height so that the height diminishes from said inlet to said outlet;

a plurality of rollers extending transverse of the passage and which engage the material to aid in crushing the material, at least one of the rollers has a generally central longitudinal axis, and the roller is mounted for rotation about a rotational axis spaced from the longitudinal axis; and a motor to rotatably drive at least one of the rollers.

2. The assembly of claim 1, wherein the rollers are mounted in the first jaw member.

3. The assembly of claim 1, wherein the first and second jaw members are pivotally attached adjacent said inlet for relative angular movement to alter said height.

4. The assembly of claim 1, wherein said actuator is located adjacent said outlet.

5. The assembly of claim 1, wherein said second jaw member has cutting ridges that engage the material passing along the passage.

6. The assembly of claim 1, wherein all of the rollers have a longitudinal axis, and each of the rollers has a respective rotational axis that is spaced from the respective longitudinal axis of the roller.

7. The assembly of claim 1, wherein at least one of the rollers includes a roller body, and a roller sleeve mounted on the roller body so as to generally encompass the roller body and movable angularly thereabout.

8. The assembly of claim 1, wherein the crusher assembly is a bucket including a scoop portion adjacent said inlet to aid in delivering material to said passage.

* * * * *